US007782268B2

(12) United States Patent
Carroll et al.

(10) Patent No.: US 7,782,268 B2
(45) Date of Patent: Aug. 24, 2010

(54) ANTENNA ASSEMBLY

(75) Inventors: Niallo Donal Carroll, Dublin (IE); Fergal Joseph Lawlor, Emo (IE)

(73) Assignee: Kavveri Telecom Products Limited, Bangalore (IN)

( * ) Notice: Subject to any disclaimer, the term of this patent is extended or adjusted under 35 U.S.C. 154(b) by 831 days.

(21) Appl. No.: 11/290,936

(22) Filed: Nov. 30, 2005

(65) Prior Publication Data

US 2007/0001919 A1 Jan. 4, 2007

(30) Foreign Application Priority Data

Dec. 1, 2004 (GB) ..... 0426319.0

(51) Int. Cl.
*H01Q 1/52* (2006.01)

(52) U.S. Cl. ..... 343/841; 343/758

(58) Field of Classification Search ..... 343/700 MS, 343/841, 890, 853, 757, 758
See application file for complete search history.

(56) References Cited

U.S. PATENT DOCUMENTS

| | | | | |
|---|---|---|---|---|
| 5,828,339 | A | 10/1998 | Patel | |
| 5,917,455 | A | 6/1999 | Huynh | |
| 6,008,750 | A | 12/1999 | Cottle | |
| 6,118,405 | A * | 9/2000 | Mckinnon et al. | 343/700 MS |
| 6,198,458 | B1 | 3/2001 | Heinz et al. | |
| 6,429,816 | B1 * | 8/2002 | Whybrew et al. | 343/700 MS |
| 6,462,710 | B1 * | 10/2002 | Carson et al. | 343/700 MS |
| 6,538,611 | B2 * | 3/2003 | Noro | 343/725 |
| 6,621,469 | B2 * | 9/2003 | Judd et al. | 343/853 |
| 6,646,328 | B2 * | 11/2003 | Tsai | 257/659 |
| 6,674,013 | B2 * | 1/2004 | Noro et al. | 174/152 G |
| 6,842,157 | B2 * | 1/2005 | Phelan et al. | 343/893 |
| 6,879,294 | B2 * | 4/2005 | Yuanzhu | 343/725 |
| 6,888,503 | B2 * | 5/2005 | Shikata | 343/700 MS |
| 6,940,469 | B2 * | 9/2005 | Gottl et al. | 343/890 |
| 2001/0054983 | A1 | 12/2001 | Judd | |
| 2006/0279727 | A1 * | 12/2006 | Nichols et al. | 356/139.01 |
| 2007/0146230 | A1 * | 6/2007 | Overhultz et al. | 343/895 |

FOREIGN PATENT DOCUMENTS

| | | | |
|---|---|---|---|
| FR | 2710195 | A1 | 3/1995 |
| GB | 2332568 | A | 6/1999 |
| WO | WO-02/07254 | A1 | 1/2002 |
| WO | WO-02/39541 | A2 | 5/2002 |

* cited by examiner

*Primary Examiner*—Tan Ho
(74) *Attorney, Agent, or Firm*—Marshall, Gerstein & Borun LLP

(57) ABSTRACT

An antenna assembly for a cellular telecommunications system has an antenna having an array (1) of radiating elements, for example patches, situated in front of a panel (2) having an electrically conductive face. An amplifier (6) for amplifying RFS signals received by the antenna is situated on the opposite side of the panel (2) from the radiating elements. The amplifier is situated at least partially within the signal shadow cast by the panel (2) so that the latter shields the radiating elements from the amplifier. The amplifier can thus be situated close to the antenna without adversely affecting the performance of the latter.

8 Claims, 5 Drawing Sheets

Tx band pass filter 2110-2170Mhz rejects signals outside this band

Rx band pass filter 1920-1980Mhz rejects signals outside this band

ANTENNA ASSEMBLY

FIELD OF THE INVENTION

This invention relates to an antenna assembly for a cellular telecommunications system and to an RF signal amplifier for such an assembly.

BACKGROUND TO THE INVENTION

A base station of a radio cellular telecommunications system is connected to one or more amplifier assemblies via which the base station receives signals from and transmits signals (from the network) to mobile units within the range of the base station. Many such antenna assemblies will include (in the antenna radome) phase shifters for altering the antenna beam tilt. Due to handset power and battery life restrictions on the mobile units, the signals received from the mobile units can be of a very low intensity. In previous generations of cellular mobile telephone systems, mast head amplifiers were occasionally required in order to boost the signals received by the antennas.

However, during the deployment of the current 3G UMTS telecommunications system it has become apparent that an amplifier is required at each antenna. A mast head amplifier needs to include various high frequency filters which take the form of filter cavities. As a result, mast head amplifiers tend to be relatively large metal objects, which, if placed too close to the radiating elements of the antenna arrays, could cause pattern interference.

Consequently, a mast head amplifier is conventionally mounted in a position spaced from the radome which contains the radiating elements of the antenna. Thus the mast head amplifier needs to be provided with its own weather proofing, and therefore considerably adds to the size and cost of the mast head amplifier and antenna assembly. In addition, the increased size of the assembly can lead to possible problems in obtaining planning permission for erecting the apparatus.

Furthermore, the loses associated with the cabling used to connect the mast head amplifier to the antenna radome and the radome ports to be the phase shifter can degrade the received signal.

SUMMARY OF THE INVENTION

According to a first aspect of the invention, there is provided an antenna assembly for a cellular telecommunications system, the assembly comprising an antenna having an array of radiating elements for transmitting and/or receiving RF signals, a panel having an electrically conductive face, said panel being situated adjacent to the radiating elements, and an amplifier for amplifying RF signals received by the antenna, wherein the amplifier is situated on the opposite side of the panel from the radiating elements so that said panel shields the radiating elements from the amplifier.

Preferably the panel provides a back plane for the amplifier.

Since the amplifier is shielded by the plate/back plane, it can be situated in close proximity to the antenna, thus enabling the assembly to be of relatively compact construction.

Preferably, the antenna is contained within a radome, which also contains the amplifier.

The arrangement avoids the need for jumper cables to connect the amplifier to sockets to the base of the radome, since instead the amplifier can be connected directly to the antenna or its phase shifter in the radome and the radome RF input/output ports can constitute the input/output ports for the amplifier. Thus the insertion losses usually associated with such cables are also avoided.

Preferably, the antenna is situated wholly within an area bounded by a perpendicular projection from the panel's perimeter. Consequently, the amplifier is situated in the signal shadow of the antenna assembly (cast by the back plane) so that the amplifier does not affect the antenna beam pattern.

This enables the amplifier to be situated very close to the antenna, thus further facilitating the compact construction mentioned above.

Preferably, the panel of the antenna is elongate, and the amplifier is contained in an elongate amplifier housing, the elongate axes of the panel and the amplifier housing being substantially parallel.

Preferably, both the panel and the amplifier housing are rectangular, when viewed in front elevation.

Preferably, the amplifier housing is of the same width as the panel. This enables the use of the available area provided by the shadow of the antenna to be maximised.

Preferably, the array of radiating elements comprises an array of patch assemblies.

It has been found at patch assemblies enable the antenna to be of relatively compact construction, and more particularly to be considerably less deep than antennas which use other types of radiating element. Consequently, situating the amplifier behind the panel does not require a significantly deeper radome than is used in conventional antenna assemblies.

The antenna assembly may to advantage also include a remotely operable beam tilting device, also situated in the housing, the device being operable to enable the beam tilt of the array of radiating elements to be remotely adjusted.

Preferably, this device is also located behind the panel, adjacent to the amplifier.

This enables the antenna phase shifter to be connected to the amplifier through one or more relatively short links/cables. In conventional MHA/Antenna configurations there can be up to 1 dB insertion loss between the output of the MHA and the inputs of the phase shifter. This extra insertion loss results in the degradation of the noise figure of the MHA/antenna system.

The invention enables these insertion losses to be reduced or eliminated.

In conventional Antenna/Mha configurations there can also be problems with the build up of return losses of each component. For a standard configuration the component return losses are typical built up as shown below.

| | |
|---|---|
| MHA | −18 dB |
| Antenna | −15 dB |
| Jumper Cable | −25 dB |

In the worst case there can be losses of −12.9 dB which can cause alarms in the base station to protect amplifiers from large reflections. This poor return loss caused extra insertion loss due to mismatch further degrading system performance.

The invention allows the system to be tuned for better than −15 dB performance, a performance that could only be achieved by specifying excessively high component performance in a conventional configuration.

Preferably, the beam tilting device comprises a phase shifter for controlling the relative phases of signals fed to or received from the radiating elements.

Preferably, the phase shifter is an electromechanical device having a motor for adjusting the phase shifter to alter said relative phases.

Preferably, the gain of the amplifier and said beam tilting device are controlled by a common control module which controls both components in response to control signals from a remote location.

The common control module can be such as to enable the control signals for both the amplifier and phase shifter to be modulated on the same RF carrier at any one time. Thus the control signals can be supplied from the base station to the antenna assembly via one of the RF feeds connecting those two components.

In known systems, the separate amplifier or an antenna has its own control module, which is supplied with control signals by a dedicated control line. The phase shifter of such an arrangement also has a control module, which receives control signals via the RF feed from the base station. Such signals are modulated onto a carrier frequency. By having a common control module for both the amplifier and the phase shifter, it is possible to modulate control signals for both devices onto a carrier supplied through the RF feed.

A common integrated control module enables more devices to be accommodated on the antenna line. The number of separate addresses for the control signal is limited to 32. By controlling more than one device from one control module (corresponding to a respective address) the number of devices that can be supported is increased.

The common control module further reduces the possibility of address conflict and masking since, in a system having a plurality of such antenna assemblies, the number of control modules communicating (for example using RS 485 protocol) along a serial signal bus is lower than would be the case if each phase shifter and mast head amplifier had its own respective control module.

The invention also lies in an RF amplifier for use as a mast head amplifier in a cellular radio-telecommunications systems (preferably a 3G UMTS network), the amplifier being so sized and shaped as to fit within an antenna radome. To that end the amplifier housing preferably is of a length less than 450 mm, a width less than 130 mm and thickness less than 220 mm.

BRIEF DESCRIPTION OF THE DRAWINGS

The invention will now be described, by way of example only, with reference to the accompanying drawings in which.

DETAILED DESCRIPTION

Figure 1:
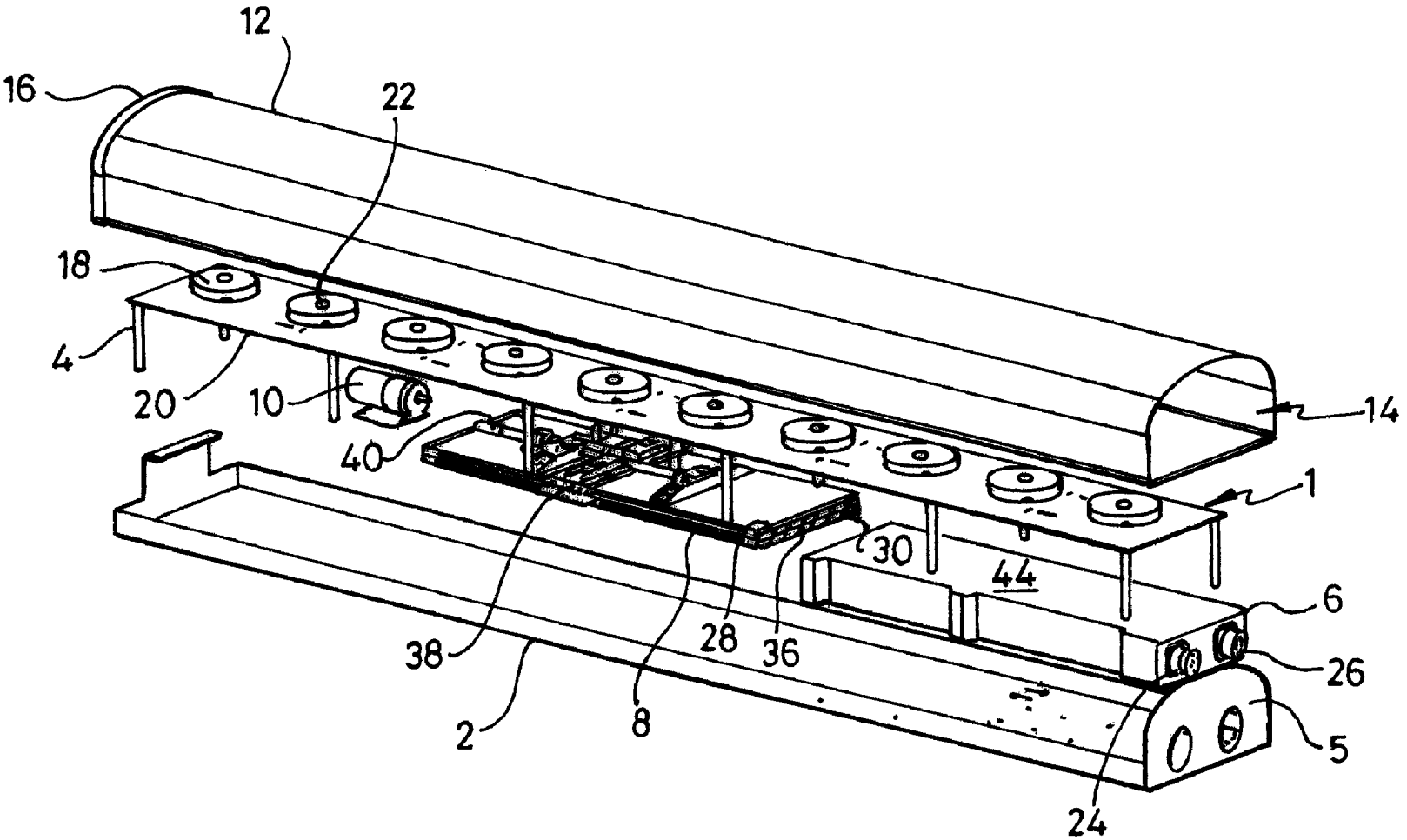
FIG. 1 is an exploded isometric view of an antenna assembly in accordance with the invention.
Figure 2:
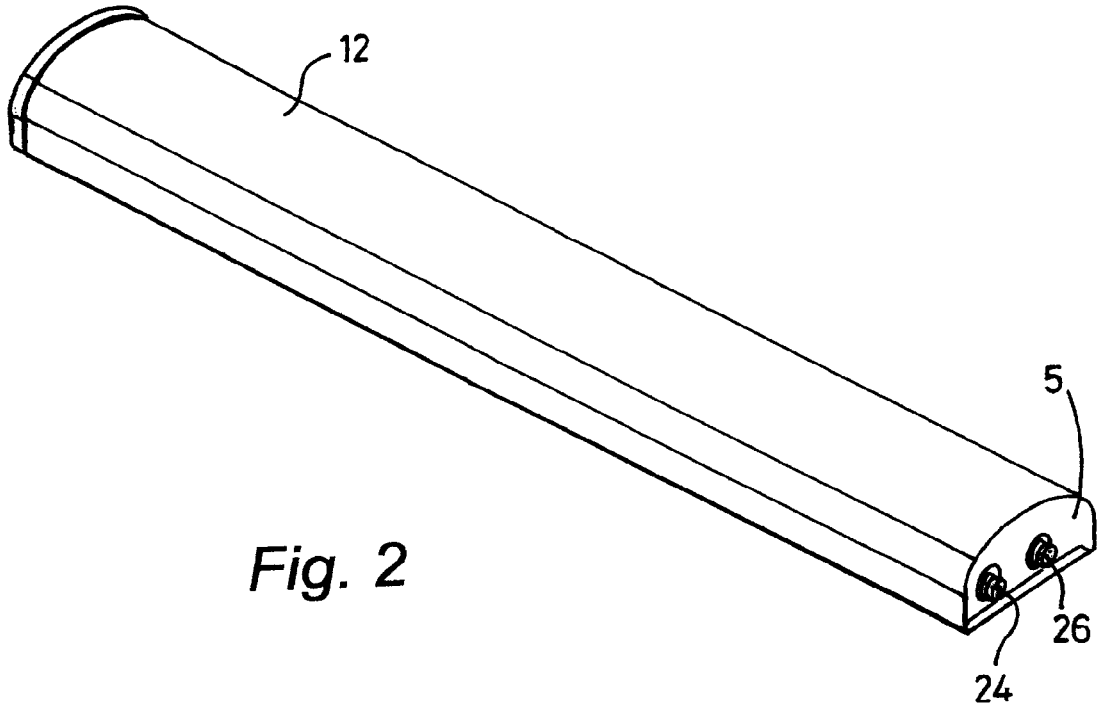
FIG. 2 is an isometric view of the exterior of the assembly.
Figure 5:
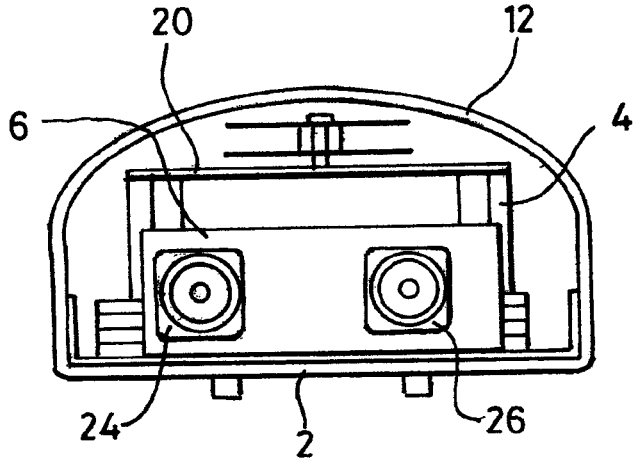
FIGS. 3, 4 and 5 are cut-a-way views, in plan, side elevation and from one end (the lower end) respectively of the antenna assembly.

With reference to FIGS. 1-5, the antenna assembly comprises a radiating patch array 1 mounted on a base plate 2 through perpendicular spacers such as spacer 4 to define a gap that extends along the length of the assembly and that accommodates a mast head amplifier 6, a phase shifter assembly 8 and an actuating motor 10 for operating the phase shifter assembly 8.

All the aforesaid components are contained in an elongate radome 12 which is open at its bottom end 14 to allow for the insertion of the components and is sealed at its top by means of a cap 16.

The radiating patch assembly 1 is of the kind currently sold by the applicants, and is substantially as described in the UK patent specification no. GB 2364175B. The assembly thus comprises a linear array of radiating patch sub-assemblies, for example sub-assembly 18, mounted via dielectric spacers on a panel 20. The upper surface of the panel 20 is coated in copper, and the lower surface of the panel has a feed/reception network of transmission lines for use in connecting each patch sub-assembly to a respective feed port on the phase shifter assembly 8. Each patch sub-assembly comprises an upper and a lower circular panel which are held in spaced relationship with each other by a central spacer element for example the element 22, in the form of a dielectric column extending perpendicularly between the two circular panels (and protruding through a central hole in the upper circular panel).

It will be appreciated that the radiating patch array 1 is operable to send and receive signals in two polarities. Accordingly, the amplifier 6 has two input ports 24 and 26 each for a respective polarity of transmitted and received signals, and which protrude from a bottom end plate 5 constituted by a perpendicular projection of an end of the base plate 2.

The phase shifter assembly 8 comprises a pair of microstrip antenna phase shifters, one for each respective polarity of signals sent/received by the radiating patch assembly 1. Each phase shifter has an input feed 28 and 30 for connection to a respective RF input/output port 32 and 34 (FIG. 6) of the amplifier 6. Each microstrip phase shifter also has ten output feeds, each for connection to a respective patch sub-assembly (via the feed/reception network of transmission lines on the panel 20). One example of such an output feed shown at 36.

The relative phases of signals at these feeds are controlled by means of a common dielectric slider 38 which is slideably mounted between the two phase shifters and is connected to the motor 10 by means of a worm drive 40, although the motor's is shown as spaced from the drive 40 in the drawings for the sake of clarity. Consequently, the motor 10 controls the linear position of the slider 38, and hence the relative phases of the signals (transmitted or received) at the output feed of the phase shifter assembly 8.

The linear position of the slider 38 and the angular position of the output shaft of the motor 10 are monitored by means of an opto-electronic feedback system. The feedback system uses a series of LEDs and photo-transistors, collectively denoted by reference numeral 42 in FIG. 6, in a housing (not shown) which are connected to the phase shifter assembly by means of fibre optic cables (also not shown).

The form and function of the phase shifter assembly 8, the motor 10 and the feedback system are as described in the applicant's existing PCT Patent Application No. PCT/EP2004/006054, the contents of which are incorporated herein by reference.

The components of the amplifier 6 are contained within a housing 44 which is generally rectangular in plan (and also in side and end elevation).

In order to fit within the antenna assembly, the amplifier 44 is more narrow than a conventional mast head amplifier. However, in order to accommodate the necessary components of the amplifier the housing 6 is longer than that of a conventional mast head amplifier. More specifically, the amplifier housing 44 is 130 mm wide, 46 mm thick and 442 mm long.

Figure 3:
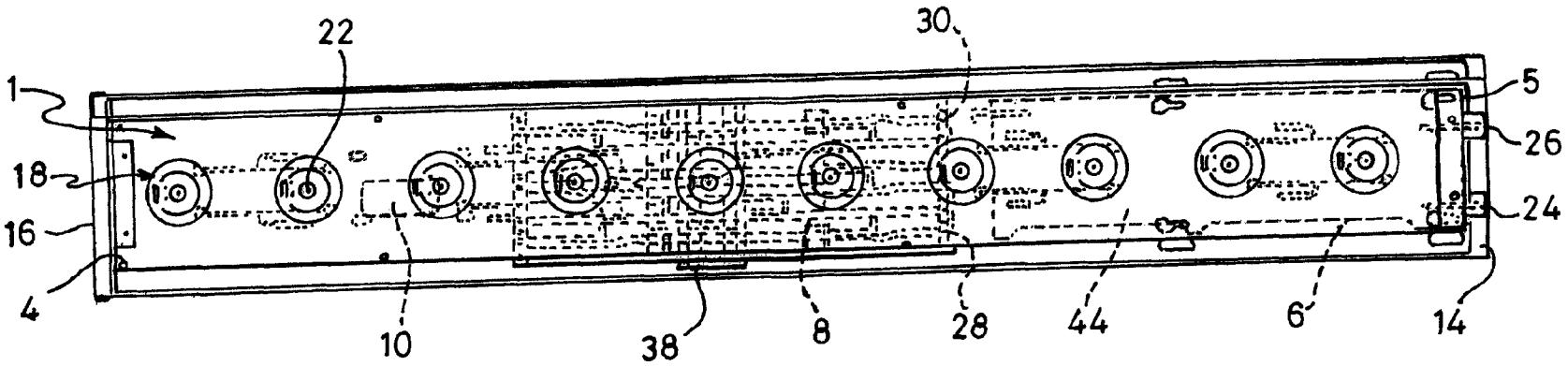
Figure 4:
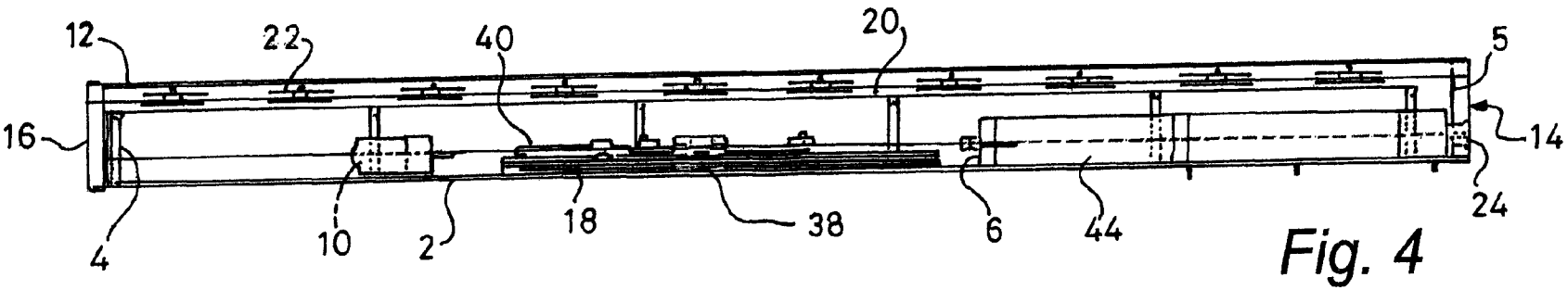

As can be seen from FIG. 3, the width of the housing 44 is slightly less than that of the panel 20, so that the amplifier 6 is situated wholly behind the panel 20. As a result, the amplifier 6 can be situated close to the rear of the panel 20 without extending into any path of signals transmitted or to be received by the antenna assembly. The amplifier 6 is thus within the 'shadow' or footprint of the panel 20.

Figure 6:
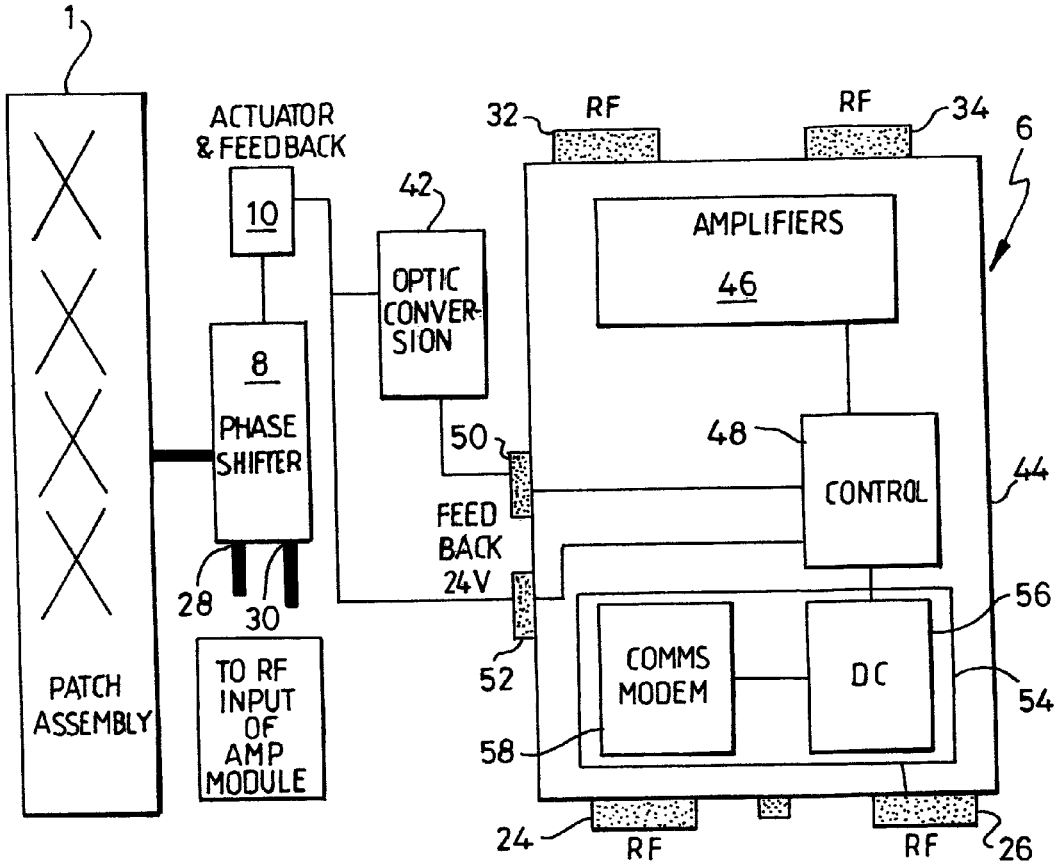
FIG. 6 is a block diagram of the components of the assembly.

With reference to FIG. 6, the amplifier 6 includes amplification circuitry 46 (shown in more detail in FIG. 7) and also incorporates a common control module 48 connected to the feedback system 42 and motor 10 via ports 50 and 52 respectively. The control module 48 is also connected to a current injector level 1 converter (Ciloc) 54. This converter is connected to the RF port 26 and includes a DC module 56 that taps off DC power from the RF line for powering the amplifier circuitry 46 and the motor 10. The Ciloc 54 also includes a communications modem 58 that decodes serial control signals modulated onto a carrier signal on the RF line connected to the port 26 (by an equivalent device at the base station end of the RF feeder cable). The modem 58 converts this type of communication to a digital serial communication to the control module 48. The control communication conveys information about the desired down tilt of the antenna assembly and gain used by the amplifier circuitry 46 to amplify the RF signals received by the radiating patch array 1.

Figure 7:
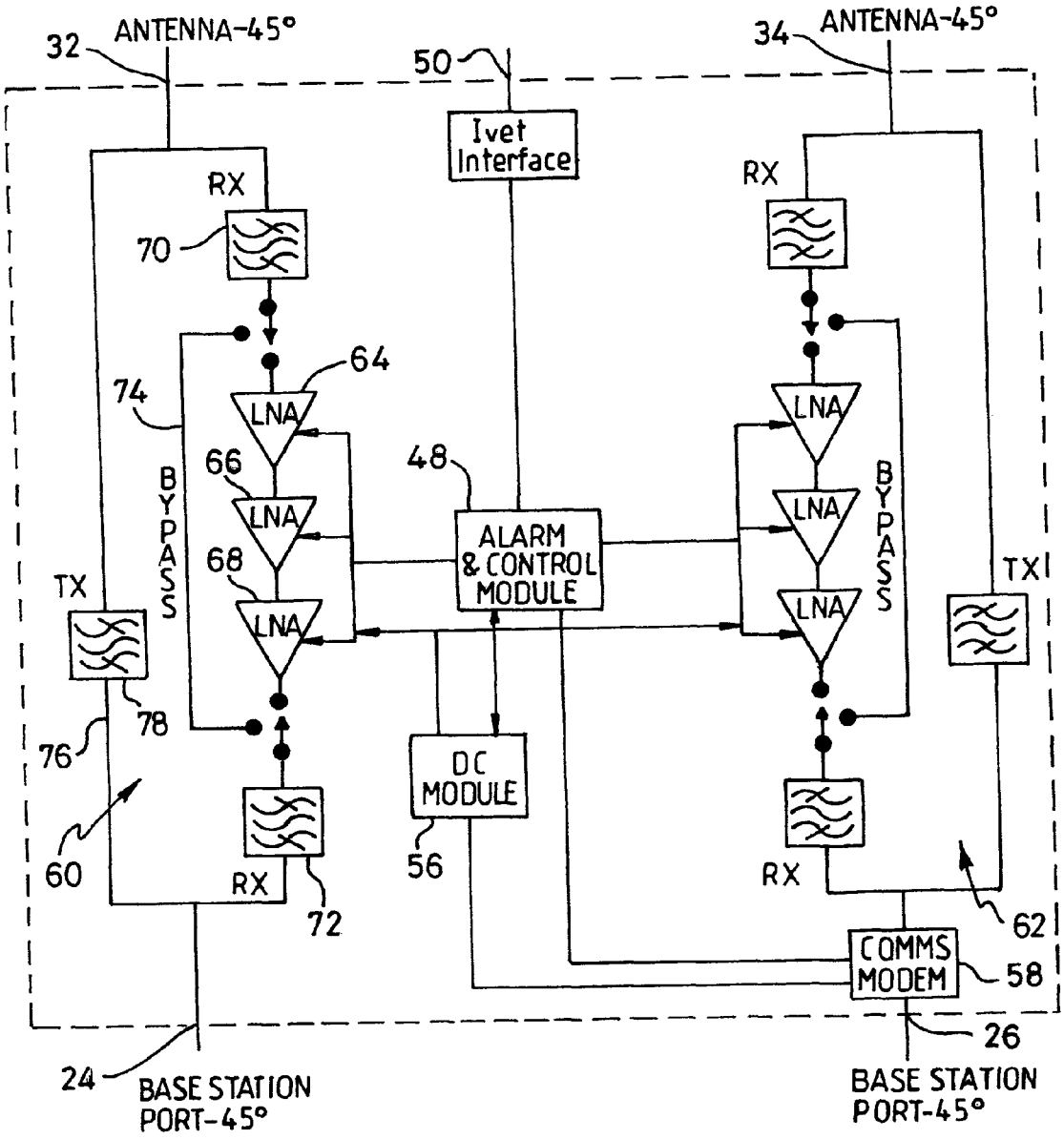
FIG. 7 shows an integrated mast head amplifier and control module forming part of the assembly.

As can be seen from FIG. 7, the amplifier circuitry 46 defines two sets of components, referenced 60 and 62, one for each polarity of signal. The sets of components 60 and 62 are identical to each other, and only the set 60 will therefore only be described. Three low noise amplifiers 64, 66 and 68, are connected in series between two Rx band pass filters 70 and 72. The filters pass signals in the band 1920-1980 MHz, whilst rejecting signals outside that band. A bypass connector 74 is also connectable between the filters 70 and 72 to bypass the amplifiers 64, 66 and 68. Such connection is achieved by means of electronic switches (not shown), and the bypass connection is closed in the event of a failure in the power supply to the amplifiers. In that case, received signal (albeit reduced magnitude due to insertion losses of less than 3 dB) will still be conveyed from the terminal 32 to the terminal 24 even if the amplifiers are unable to boost or pass any signal as the result of the power failure.

The circuitry also includes a transmission path, generally indicated as 76 in which there is provided a transmission filter 78 which is a band pass filter passing signals in band 2110-2170 MHz.

The gain levels in the amplification the signals received at the terminal 32 can be changed by switching on a variable number of the amplifiers 64, 66 and 68. Each amplifier has a gain of 12 dB, so that, in 12 dB mode only one of the amplifiers is used, in 32 dB mode or 36 dB mode all three of the amplifiers are used. Any amplifier which is not switched on will be bypassed by bypass circuitry (not shown), and the activation of the amplifiers is controlled by means of the module 48.

In conventional arrangements, the beam tilt data for controlling the phase shifter is modulated on a carrier of specific frequency 2.1 KHz on the signal supplied to the control module for the phase shifter. This is then de-modulated for conversion back to RS485 format, in which there will be a command set including command such get-tilt, set-tilt, calibrate etc. In the conventional arrangements, the mast head amplifier would be controlled (via a dedicated control line) by means of a similar command set except gain would replace tilt so as to give get-gain and set-gain. Thus, in the known systems, the mast head amplifier and the phase shifter would appear to the control software as two different devices which have different addresses and identities. In the presently described arrangement, however, the antenna assembly appears as a single device with a number of extra parameters to control, by means of the control signal modulated onto the carrier fed to the terminal 26.

Thus the control signal will have an address code identifying the control module (and hence the phase shifter and amplifier) and will convey data on the required tilt of the antenna beam (and hence whether any movement of the slider 38 is required) and the necessary gain for the amplifier (i.e. the number of the low noise amplifiers that need to be operated). These signals are defined by the AISG protocols or similar.

A further advantage of the invention is that the amplifier 6 is positioned very close to the input feeds 28 and 30 of the phase shifter assembly 8 so that only relatively short lengths of cable are required to connect the amplifier to the phase shifter.

Furthermore, various site specific information such as sector, bearing and site location which are relevant to the operation of the phase shifter and the amplifier only have to be programmed into one control module, thus facilitating the set-up of the assembly.

The invention claimed is:

1. An antenna assembly that is used for a two-way base station of a cellular telecommunications system and has:

an antenna that has an array of radiating elements that transmit and/or receive RF signals;

an elongate panel that has an electrically conductive face and is situated adjacent to the radiating elements; and an amplifier that amplifies RF signals received by the antenna and (a) is contained in an elongate amplifier housing that has an elongate axis that is substantially parallel to the axis of the elongate panel and (b) is situated on the opposite side of the panel from the radiating elements in a position where the panel shields the radiating elements from the amplifier.

2. An antenna assembly according to claim 1, in which both the panel and the amplifier housing are rectangular, when viewed in front elevation.

3. An antenna assembly according to claim 1, in which the amplifier housing is of a width not substantially greater than that of the panel.

4. An antenna assembly that is used for a two-way base station of a cellular telecommunications system and has:

an antenna that has an array of radiating elements that transmit and/or receive RF signals;

an panel that has an electrically conductive face and is situated adjacent to the radiating elements;

an amplifier that amplifies RF signals received by the antenna and is situated on the opposite side of the panel from the radiating elements in a position where the panel shields the radiating elements from the amplifier; and a remotely operable beam tilting device that enables the beam tilt of the array of radiating elements to be remotely adjusted.

5. An antenna assembly according to claim 4, in which said device is also located behind the panel, adjacent to the amplifier.

6. An antenna assembly according to claim 4, in which the beam tilting device comprises a phase shifter for controlling the relative phases of signals fed to or received from the radiating elements.

7. An antenna assembly according to claim 6, in which the phase shifter is an electromechanical device having a motor for adjusting the phase shifter to alter said relative phases.

8. An antenna assembly according to claim 4, in which the said beam tilting device and the gain of the amplifier are controlled by a common control module which controls both components in response to control signals from a remote location.

* * * * *